US008403159B2

(12) United States Patent
Antier et al.

(10) Patent No.: US 8,403,159 B2
(45) Date of Patent: Mar. 26, 2013

(54) STOPPER DEVICE FOR STOPPING A CONTAINER NECK

(75) Inventors: Gregory Antier, Trevoux (FR); Veronique Bernard, Anse (FR); Michel Luzzato, Ecully (FR)

(73) Assignee: Tetra Laval Holdings & Fiance S.A., Pully (CH)

( * ) Notice: Subject to any disclaimer, the term of this patent is extended or adjusted under 35 U.S.C. 154(b) by 105 days.

(21) Appl. No.: 12/920,416

(22) PCT Filed: Mar. 4, 2009

(86) PCT No.: PCT/FR2009/050346

§ 371 (c)(1),
(2), (4) Date: Aug. 31, 2010

(87) PCT Pub. No.: WO2009/115727

PCT Pub. Date: Sep. 24, 2009

(65) Prior Publication Data

US 2011/0006031 A1 Jan. 13, 2011

(30) Foreign Application Priority Data

Mar. 5, 2008 (FR) ..... 08 51429

(51) Int. Cl.
*B65D 51/00* (2006.01)
*B65D 39/00* (2006.01)
*B65D 41/00* (2006.01)

(52) U.S. Cl. ..... 215/253; 215/235; 215/216; 222/541.1; 222/541.5; 222/556

(58) Field of Classification Search ..... 215/235, 215/237, 250, 252, 253, 256, 316, 355, 40, 215/43, 216, 254, 295; 220/353, 703, 801, 220/804, 281–283; 222/556, 563, 541.1, 222/541.3–541.6, 562
See application file for complete search history.

(56) References Cited

U.S. PATENT DOCUMENTS 4,838,441 A * 6/1989 Chernack ..... 215/216
(Continued)

FOREIGN PATENT DOCUMENTS

WO 95/07223 3/1995
WO 03/016162 2/2003
(Continued)

*Primary Examiner* — Mickey Yu
*Assistant Examiner* — Brijesh V Patel
(74) *Attorney, Agent, or Firm* — Finnegan, Henderson, Farabow, Garrett & Dunner, LLP

(57) ABSTRACT

A stopper device is disclosed. The stopper device includes a substantially tubular support defining a first axis, and a tab extending along a second axis substantially perpendicular to the first axis. A cap is hinged to the support to pivot between a closed position and an open position. A tamper-proofing band is connected to the cap in its closed position via at least one breakable bridge situated along a third axis in a portion of the tamper-proofing band. The third axis is substantially perpendicular to the first and second axes when the cap is closed. The cap is pivoted from the closed position to the open position by squeezing along the third axis. During a first stage of the squeezing, the at least one breakable bridge is broken, and during a second stage of the squeezing after the first stage, the fastener tab disengages from the cap opening.

12 Claims, 4 Drawing Sheets

U.S. PATENT DOCUMENTS

| | | | | |
|---|---|---|---|---|
| 5,141,138 | A * | 8/1992 | Odet et al. | 222/153.07 |
| 5,328,058 | A * | 7/1994 | Leoncavallo et al. | 222/153.14 |
| 6,334,555 | B1 * | 1/2002 | Randall et al. | 222/521 |
| 6,631,820 | B2 * | 10/2003 | Harrold et al. | 215/237 |
| 6,821,239 | B2 * | 11/2004 | Hierzer et al. | 493/344 |
| 7,044,317 | B2 * | 5/2006 | Smith et al. | 215/235 |
| 7,661,546 | B2 * | 2/2010 | Jiang | 215/11.1 |
| 2004/0069806 | A1 * | 4/2004 | Benoit-Gonin et al. | 222/153.06 |
| 2005/0173367 | A1 * | 8/2005 | Nusbaum et al. | 215/237 |
| 2005/0205607 | A1 * | 9/2005 | Hierzer et al. | 222/153.1 |
| 2005/0279727 | A1 * | 12/2005 | Graswald et al. | 215/237 |
| 2007/0284392 | A1 * | 12/2007 | Kaess et al. | 222/153.05 |
| 2008/0169261 | A1 * | 7/2008 | Druitt et al. | 215/237 |

FOREIGN PATENT DOCUMENTS

| | | |
|---|---|---|
| WO | 2006/027484 | 3/2006 |

* cited by examiner

STOPPER DEVICE FOR STOPPING A CONTAINER NECK

The present invention relates to a stopper device for stopping the neck of a container.

In the field of packaging of liquids, it is known that the threaded or non-threaded neck of a container can be equipped with a stopper device that is generally made of a plastics material, and that comprises a cap hinged to a support to pivot between a closed position and an open position. This support is of tubular overall shape, and is itself designed to be held stationary around the neck. This type of device is often designed to enable the user to drink directly from the neck of the container.

Document WO-A-95/07223 discloses a stopper device comprising a cap, and a support defining a longitudinal first axis. That device further comprises a fastener tab extending along a transverse second axis that is perpendicular to the first axis. Unfortunately, the user does not have any guarantee that the stopper device being used has not been opened previously. The contents of the container equipped with the device might therefore have come into contact with the outside air since the initial stopping of the container, due to possible breakage of the leaktight contact between the stopper and the support, before the device is opened for the first time. In order to mitigate that drawback, provision may be made to use a tamper-proofing band.

Before that type of stopper device is used for the first time, i.e. before the cap is opened for the first time relative to the support, the cap, carried by the support, is connected to the tamper-proofing band. That connection is suitable for being broken when the device is opened for the first time. To this end, one or more breakable bridges are interposed between the band and the stopper in such a manner that when the cap is driven from its closed initial position, in which it is in leaktight contact with the support, towards an open position, in which it is spaced apart from the support, said bridges are deformed and then broken.

Unfortunately, in practice, the use of such breakable bridges offers only a limited guarantee for the user. In the event of impacts during transport, or in the event of high pressure inside the container, due to the presence of a carbonated beverage, for example, the stopper device might be opened for the first time in unwanted manner. The bridges can thus break, and intact leaktight sealing between the stopper and the support is no longer guaranteed for the user. It is also often very difficult to see whether the bridges have been broken. In addition, it is not impossible that the cap might, without breaking the bridges, be spaced sufficiently apart from its closed position for the leaktight sealing of the device to be adversely affected. In other words, the contents of the container equipped with such a device can be polluted, intentionally or otherwise, from the outside, thereby resulting in the user running significant health and safety risks.

An object of the present invention is to provide a stopper device that is sufficiently strong to prevent it from being opened for a first time accidentally or with malicious intent, while also being easy to use for the consumer.

To this end, the invention provides a stopper device for stopping a container neck, as defined in claim 1.

By means of the device of the invention, the consumer needs to apply only a small amount of force in order to open the cap. Once the user has squeezed the cap laterally, the fastener tab is released after the bridges break. In parallel to this ease of use, the device is robust enough to guarantee a satisfactory level of security and safety due to the association of the tamper-proofing band and of the fastener tab. In addition, so long as the bridges are not broken, it is guaranteed that the leaktight sealing between the cap and the spout is intact.

Advantageous characteristics of the stopper device of the invention, taken in isolation or in any technically feasible combination, are defined in dependent claims 2 to 11.

The invention can be understood more clearly on reading the following description given merely by way of example, and with reference to the drawings, in which.

Figure 2:
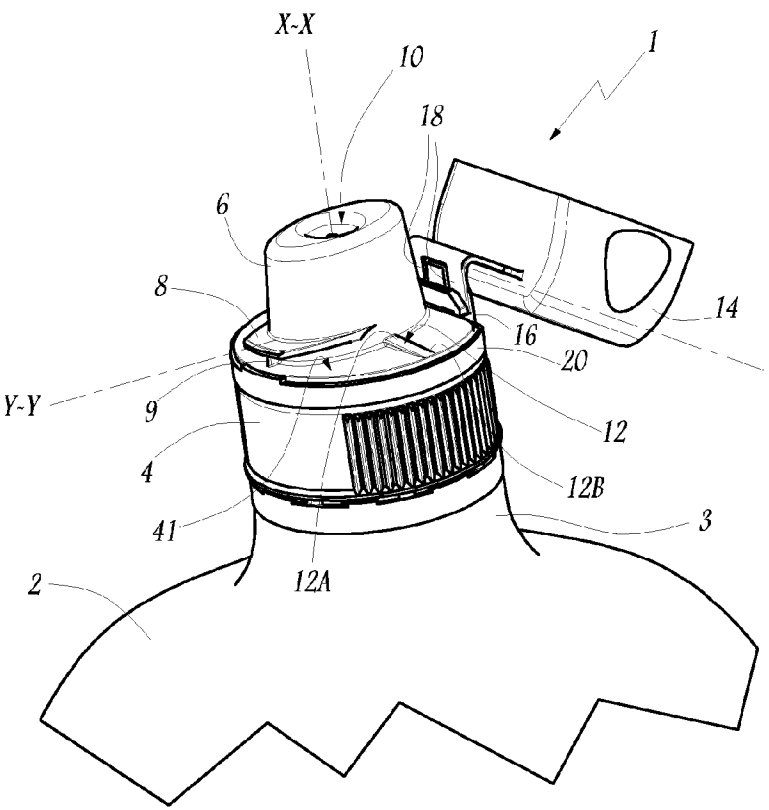
FIG. 2 is a view analogous to FIG. 1, with the cap of the device in the open position.
Figure 1:
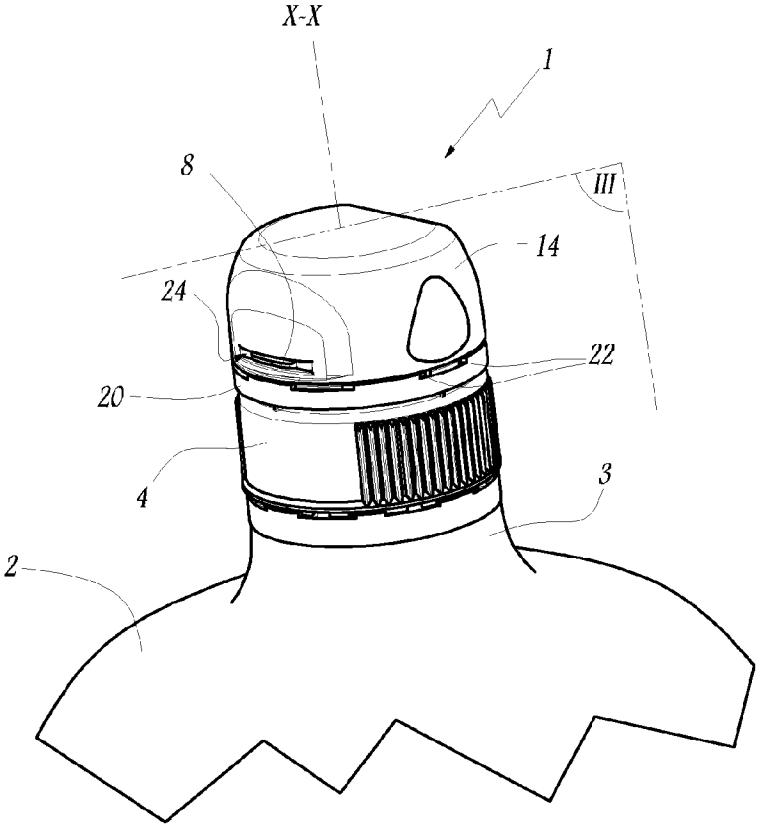
FIG. 1 is a perspective view of a stopper device of the invention, with its cap in the closed position, and mounted around a container neck.
Figure 3:
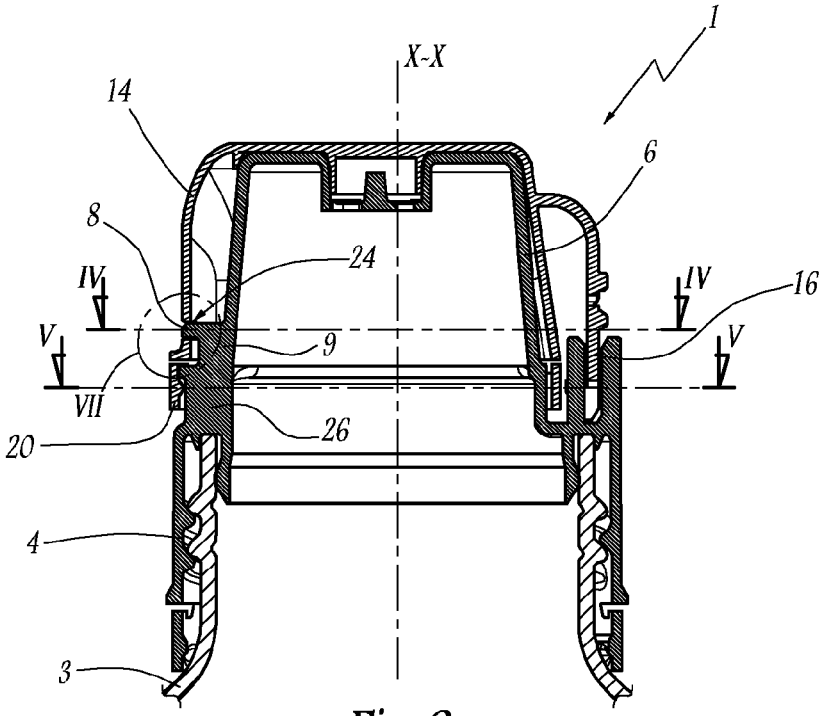
FIG. 3 is a section view of the device on plane III of FIG. 1.

FIGS. 1 to 5 show a stopper device 1 for stopping a container 2 that is visible in fragmentary manner in FIGS. 1 and 2 only. For example, the container is a bottle made of polyethylene terephthalate (PET) and containing a drinkable liquid, such as mineral water, or some other liquid.

The device 1 includes a tubular support 4 that defines a central longitudinal axis X-X. Said support 4 is positioned on a neck 3 of the container 2 by screw-fastening by means of a helical external thread disposed on a portion of the neck. A lower portion of the support 4 is provided with uniformly distributed external splines making it easier to take hold of, and easier to screw onto the neck 3 of the container 2.

Figure 4:
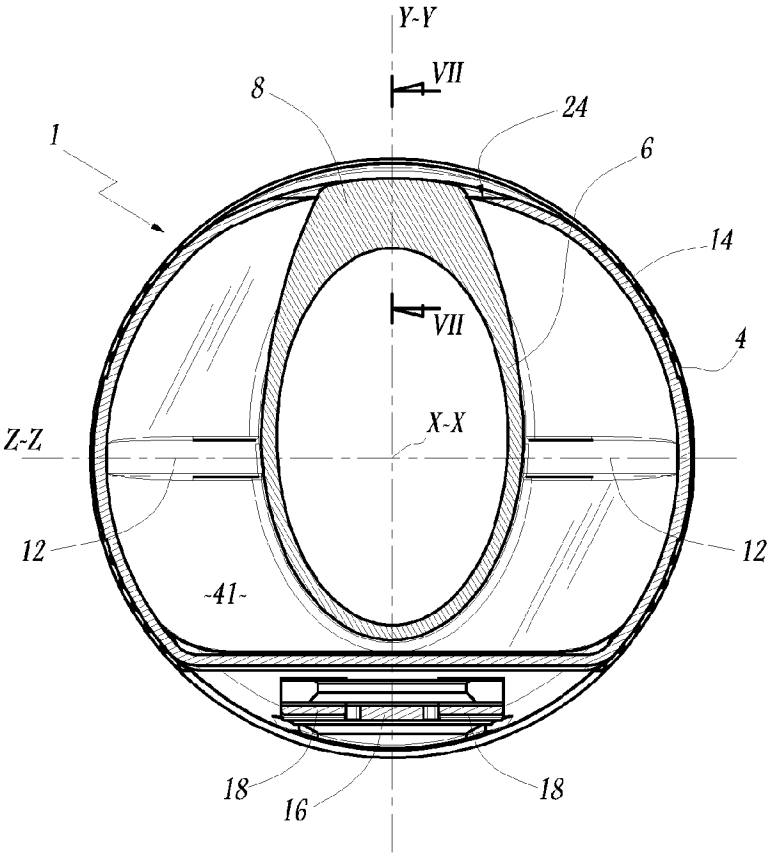

A spout 6, forming an upper portion of the support 4 is of substantially egg-shaped cross-section, with its longer dimension parallel to an axis Y-Y that is parallel to the axis X-X. The section of the spout 6, which section is shown in FIG. 4, thus has an elliptical outside profile having its main axis coinciding with the axis Y-Y and having its secondary axis substantially aligned on an axis Z-Z perpendicular both to the axis X-X and to the axis Y-Y.

The spout 6 is provided with a fastener tab 8 projecting from the elliptical body of the spout along the axis Y-Y. Said tab 8 is supported by a fin 9 that extends parallel to the axes X-X and Y-Y between the tab 8 and an upper annular surface 41 of the support 4.

The parts 4, 6, 8, and 9 are made in one piece in this example, in particular by thermoforming a plastics material chosen, inter alia, from polypropylene and polyethylene. The spout 6 is provided with an opening 10 making it possible for the liquid in the container 2 to flow out therefrom.

The support 4 is also provided with two elongate ramps 12 that are disposed along the axis Z-Z on either side of the spout 6 on the upper annular surface 41. Said ramps 12 are placed such that their ends 12A facing towards the spout 6 are of greater thickness than their ends 12B facing towards the outside of the support 4.

In addition, the device 1 includes a cap 14 hinged to the support 4. In a "closed" first position, shown in FIG. 1, the cap 14 closes off the opening 10 of the spout 6 in leaktight manner in order to prevent the liquid that is contained in the container 2 from flowing out. The tab 8 is engaged in a through opening 24 provided in the cap 14. In an "open" second position, shown in FIG. 2, the cap 14 has pivoted about an axis Z1-Z1 that is parallel to the axis Z-Z and that passes through two hinge strips 18 connecting the cap 14 to a portion 16 that is secured to or integral with the support 4.

The device 1 is also provided with a tamper-proofing band 20 of annular section. The band 20, carried by the support 4, is connected to the cap 14 in the closed position via at least one breakable bridge 22. In a preferred embodiment of the invention that is shown in FIGS. 1 and 2, two sets of two bridges 22 are disposed on either side of the spout 6, opposite each other along the axis Z-Z.

Figure 5:
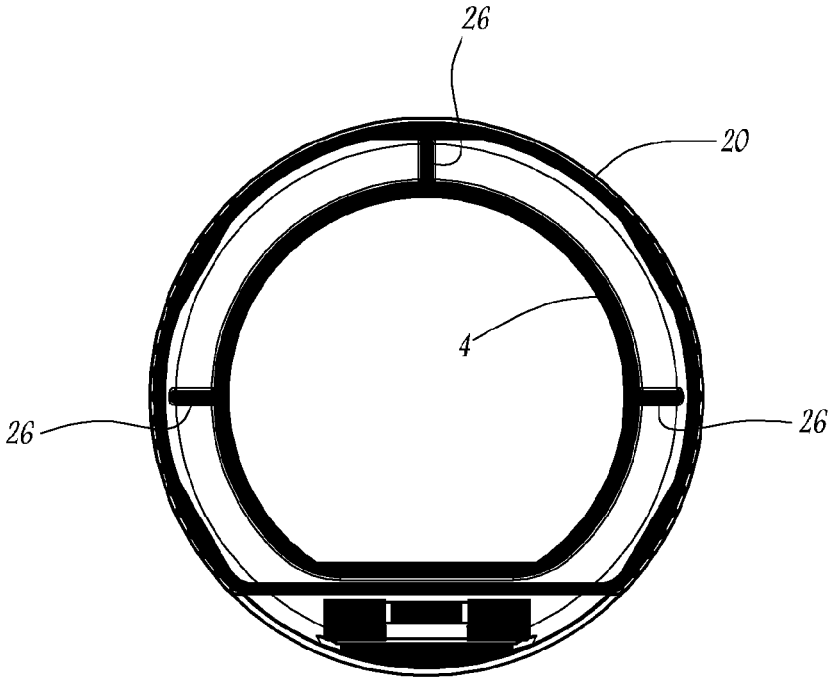
FIGS. 4 and 5 are respective section views of the device on lines IV-IV and V-V of FIG. 3.

The device 1 is provided with fins 26, shown in FIG. 5, and interposed between the band 20 and the support 4. In FIG. 5, the fins 26 are connected to the support 4. They can be either fastened by adhesive bonding to the support, or formed integrally with the support by thermoforming. Said fins 26 are projections made of a rigid plastics material and distributed uniformly around the perimeter of the support 4.

By way of a variant (not shown), the device 1 may be provided with a peripheral rib interposed between the band 20 and the support 4. The rib may be disposed over the entire perimeter of the support 4 and be made by thermoforming.

In the embodiment considered herein, the cap 14, the stationary portion 16 and the strips 18 are made in one piece, in particular by thermoforming a plastics material chosen, inter alia, from polypropylene and polyethylene.

Figure 6:
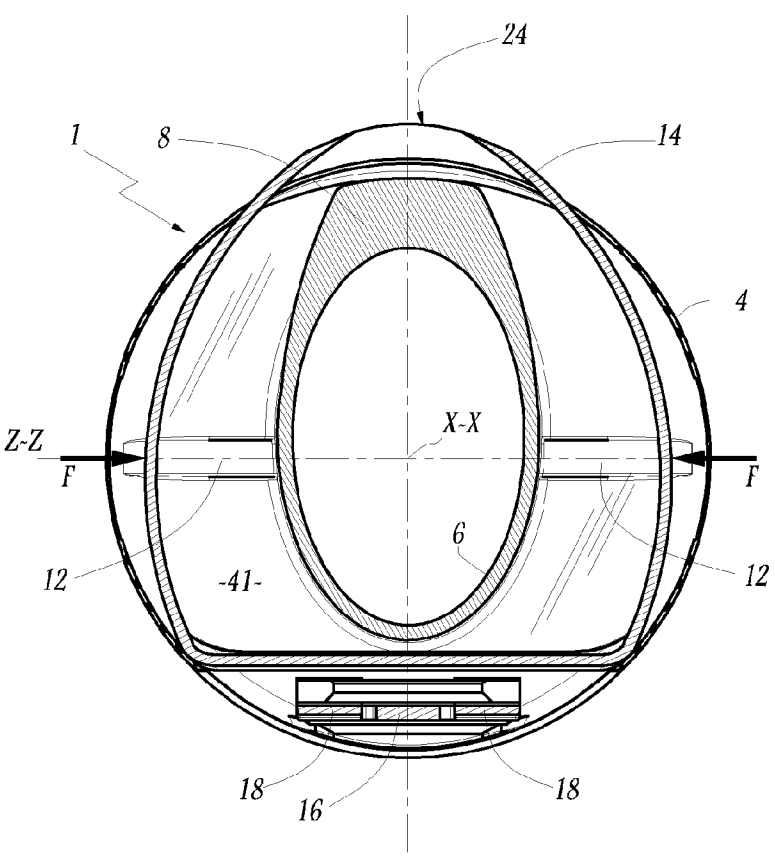
FIG. 6 is a view analogous to FIG. 4, showing the device with its cap while said cap is being opened.

When the user wishes to open the cap 14 for the first time, said user exerts pressure along the axis Z-Z. This squeezing is represented in FIG. 6 by two arrows F. During a first stage, the bridges 22 situated in a portion of the band 20 via which the axis Z-Z passes are broken. The cap 14 then takes up a substantially egg-shaped section, in particular in its portion defining the opening 24, as shown in FIG. 6. In order to make it easier to open the cap 14, the opening ramps 12 assist in the ovalization, in particular when the user does not exert the lateral pressures exactly along the axis Z-Z.

The band 20, carried in such a manner as to be movable on the support 4, then falls along the support 4. The presence of the fins 26 and/or of the above-mentioned rib makes it possible to guide the band 20 as it falls. The consumer can thus see very clearly whether said consumer is the person who opens the container 2 for the first time.

In a second stage, while the lateral squeezing along the axis Z-Z continues to be exerted, the tab 8 disengages from the through opening 24. The cap 14 can then go into its open position by pivoting about the axis Z1-Z1. The spout 6 of egg-shaped section along the axis Y-Y matches the shape of the mouth of the user. The user is thus encouraged to take the spout in the mouth in this well-determined direction. The user is not hindered by the cap 14.

It can be understood that, advantageously, the opening 10 in the spout 6 continues to be closed off in leaktight manner by the cap 14 so long as the cap has not, starting from its closed position, reached an intermediate position that is accessible to the cap only once the tab 8 has been completely disengaged from the opening 24. Thus, before the device 1 is opened for the first time, so long as the user observes that the bridges 22 are not broken, said user has a reliable guarantee that the device has not been willfully damaged, i.e. that the cap has not be previously tampered with in order to break the sealing of the device with a view to rendering the contents of the container 2 equipped with the device 1 unfit for consumption.

In a third stage, after drinking from the container, the consumer may choose to close the cap 14 again. The device is then back in the closed first position, except that the tamper-proofing band 20 remains in the position defined after it has fallen.

Figure 7:
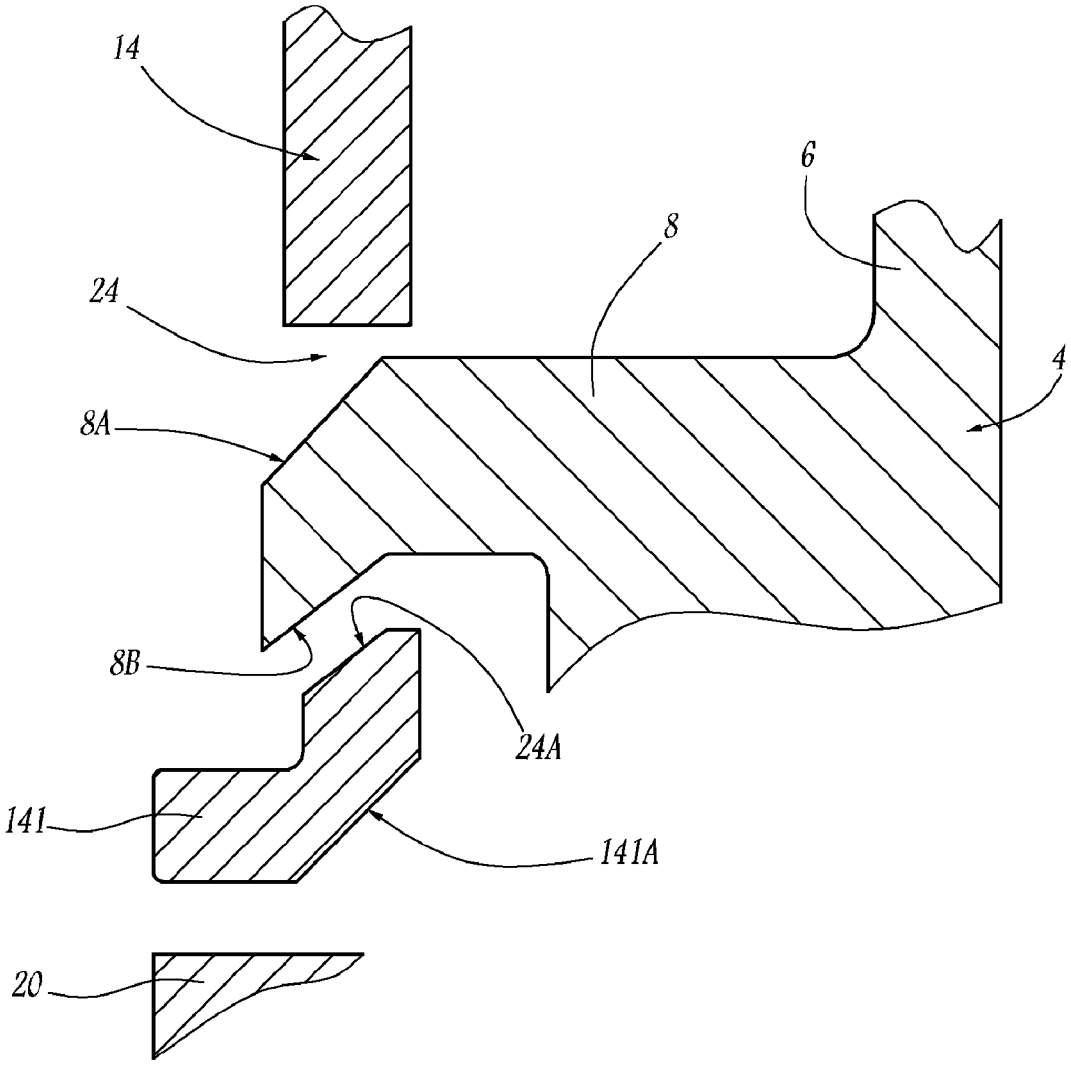
FIG. 7 is a diagrammatic section view on a large scale, showing advantageous implementation options for the encircled zone VII in FIG. 3.

By way of optional arrangements shown in FIG. 7, the upper face of the fastener tab 8 may, at its free end, form a ramp 8A that slopes upwards in FIG. 7, i.e. towards the opening 10, while going towards the axis X-X. In addition to or instead of the ramp 8A, it is possible to provide a ramp 141A on the lower end 141 of the cap 14, opposite from the hinge strips 18 and designed to come into contact with the fastener tab 8. Said ramp 141 is arranged in such a manner that, when the cap 14 is in the closed position, the ramp slopes in the same direction as the ramp 8A formed on the tab 8, i.e. towards the opening 10 in the spout 6, while going towards the axis X-X. The two ramps 8A and 141A may be formed directly by thermoforming while the tab 8 and the cap 14 are being manufactured. Putting the cap 14 back into its closed position is thus made easier by the presence of said ramps that slide against each other.

FIG. 7 shows another optional arrangement of the device 1 that, in practice, may be combined with the immediately above-described arrangements and that consists in making provision for the lower face of the fastener tab 8 to form, at its free end, a slope 8B sloping upwards while going towards the axis X-X, while the lower edge of the opening 24 defines a slope 24A that is complementary to the slope 8B. The presence of these slopes 8B and 24A makes it impossible to disengage the tab 8 from the opening 24 so long as the cap 14 is not clearly squeezed into an oval shape. If the cap 14 is squeezed into a shape that is only slightly oval, while it is being driven from its closed position to its open position, the respective lower and upper ends of the slopes 8B and 24A come into contact with each other: the slopes 8B and 24A then slide against each other so that the free end of the tab 8 then finds itself retained mechanically in the opening 24. Conversely, the relative sliding contact between said slopes does not hinder the user in imparting a more oval shape to the cap 14.

Various arrangements of and variants to the above-described stopper device 1 are also possible. By way of example:

- rather than having an elliptical base, the cylindrical shape of the spout 6, centered on the axis X-X, may have a circular base;
- the fins 26 may be formed on the tamper-proofing band 20;
- rather than being secured around the neck 3 by screw-fastening, the support 4 may be fastened by snap-fastening a portion of its lower face to a complementary portion of the neck;
- rather than forming the support 4 and the cap 14 in two distinct parts that are then assembled together, these two elements may be molded jointly, either with the cap in its closed position, or with the cap in a position in which it is spaced apart from its closed position, the cap then being moved, in particular pivoted, to its closed position; and/or
- at the opening 10 of the spout 6, it is possible to provide a peel-off or a tear-off film or seal that is advantageously provided with a tear tab; such a seal constitutes an additional indicator of whether the device has been opened for a first time, in particular when the container contains a substance that is particularly sensitive as regards preservation thereof.

The invention claimed is:

1. A stopper device for stopping a neck of a container, said stopper device comprising:

- a support that is substantially tubular, that defines a first axis, that is suitable for being secured to the neck, and that is provided with a fastener tab extending from the support along a second axis that is substantially perpendicular to the first axis;
- a cap that has a substantially annular section and that is also hinged to the support to pivot between a closed position and an open position, the fastener tab being suitable for engaging in an opening provided in the cap when said cap is in the closed position; and a tamper-proofing band having a substantially annular section, wherein the tamper-proofing band is carried movably by the support and is connected to the cap in its closed position via at least one breakable bridge, wherein the at least one breakable bridge is situated along a third axis in a portion of the tamper-proofing band, and wherein the third axis is substantially perpendicular to the first axis and the second axis when the cap is in the closed position, wherein the cap is configured to be pivoted for a first time from the closed position to the open position by squeezing laterally along the third axis, wherein during a first stage of the squeezing, the at least one breakable bridge is configured to be broken, and during a second stage of the squeezing after the first stage, the fastener tab is configured to disengage from the opening of the cap.

2. A device according to claim 1, wherein the device is provided with a plurality of bridges that are situated along the third axis in the portion of the tamper-proofing band.

3. A device according to claim 1, wherein the support is provided both with a spout forming the upper portion of the support and also with at least one opening ramp arranged in such a manner that a first end of the ramp that faces towards the spout has a height greater than the height of the opposite second end of the ramp that faces towards the outside of the support.

4. A device according to claim 3, wherein the spout is of cylindrical shape that is centered on the first axis and that has a base that is either circular or egg-shaped with its longer dimension disposed along the second axis.

5. A device according to claim 3, wherein two sets of the at least one breakable bridge are situated on respective sides of the spout that are mutually opposite along the second axis.

6. A device according to claim 1, wherein the device is provided with at least one supporting means that is adapted to guide the tamper-proofing band as it falls, once the at least one breakable bridge has been broken.

7. A device according to claim 6, wherein the supporting means includes a plurality of fins that are uniformly interposed between the tamper-proofing band and the support.

8. A device according to claim 2, wherein the device is provided with engagement means for engaging the fastener tab in the opening of the cap when the cap is moved to its closed position.

9. A device according to claim 8, wherein said engagement means include a first ramp that slopes towards an opening in the spout while going towards the first axis, and that is formed by the upper face of the fastener tab.

10. A device according to claim 9, wherein said engagement means include a second ramp that slopes towards the opening of the spout while going towards the first axis, when the cap is in the closed position, that is formed by an end of the cap, and that is suitable for coming into contact with the fastener tab.

11. A device according to claim 2, wherein the device has retaining means for mechanically retaining the fastener tab in the opening of the cap in the event that the cap is not squeezed sufficiently for it to take up an egg-shaped section, said retaining means including firstly a first slope that slopes towards the spout while going towards the first axis, and that is formed by the lower face of the fastener tab, and secondly a second slope that is complimentary to the first slope and that is formed by the lower edge of the opening of the cap.

12. A device according to claim 1, wherein, in its closed position, the cap closes off the support in leaktight manner, and wherein the support continues to be closed off by the cap in leaktight manner while the cap goes from its closed position to an intermediate position between its closed and its open positions, said intermediate position being taken up by the cap only once the fastener tab is fully disengaged from the opening of the cap.

* * * * *

UNITED STATES PATENT AND TRADEMARK OFFICE

CERTIFICATE OF CORRECTION

PATENT NO. : 8,403,159 B2
APPLICATION NO. : 12/920416
DATED : March 26, 2013
INVENTOR(S) : Gregory Antier, Veronique Bernard and Michel Luzzato It is certified that error appears in the above-identified patent and that said Letters Patent is hereby corrected as shown below:

On the Title Page

Item (73) Assignee: "Tetra Laval Holdings & Fiance S.A.," should be
-- Tetra Laval Holdings & Finance S.A., --

Signed and Sealed this
Fourth Day of June, 2013

Teresa Stanek Rea
*Acting Director of the United States Patent and Trademark Office*